US008470156B2

(12) United States Patent
Zidan

(10) Patent No.: US 8,470,156 B2
(45) Date of Patent: Jun. 25, 2013

(54) ELECTROCHEMICAL PROCESS AND PRODUCTION OF NOVEL COMPLEX HYDRIDES

(75) Inventor: Ragaiy Zidan, Aiken, SC (US)

(73) Assignee: Savannah River Nuclear Solutions, LLC, Aiken, SC (US)

( * ) Notice: Subject to any disclaimer, the term of this patent is extended or adjusted under 35 U.S.C. 154(b) by 1215 days.

(21) Appl. No.: 11/891,125

(22) Filed: Aug. 9, 2007

(65) Prior Publication Data

US 2009/0038954 A1 Feb. 12, 2009

(51) Int. Cl.
*C25B 1/02* (2006.01)

(52) U.S. Cl.
USPC ..... 205/477

(58) Field of Classification Search
USPC ..... 205/477
See application file for complete search history.

(56) References Cited

U.S. PATENT DOCUMENTS

| | | | | |
|---|---|---|---|---|
| 6,471,935 | B2 | 10/2002 | Jensen et al. | |
| 6,617,064 | B2 | 9/2003 | Petrie et al. | |
| 6,686,076 | B2 | 2/2004 | Johnson | |
| 7,153,489 | B2 | 12/2006 | Bingham et al. | |
| 2004/0009392 | A1 * | 1/2004 | Petillo et al. | 429/122 |
| 2006/0102489 | A1 | 5/2006 | Kelly | |
| 2010/0252444 | A1 * | 10/2010 | Vajo et al. | 205/477 |

FOREIGN PATENT DOCUMENTS

| | | |
|---|---|---|
| DE | 11 41 623 B | 12/1962 |
| WO | WO 01/78170 | 10/2001 |
| WO | WO 03/058748 | 7/2003 |
| WO | WO 2005/090229 | 9/2005 |
| WO | WO 2005/097491 | 10/2005 |
| WO | WO 2006/050077 | 5/2006 |
| WO | WO 2006/101214 | 9/2006 |
| WO | WO 2006/114728 | 11/2006 |
| WO | WO 2007/112203 | 10/2007 |

OTHER PUBLICATIONS

H. Senoh et al: "Electrochemical reaction of lithium alanate dissolved in diethyl ether and tetrahydrofuran", J. Power Sources vol. 164, Nov. 17, 2006, pp. 94-99, XP002527187 paragraph [0004]; table 1.

European Patent Office, International Search Report, PCT/US2008/009536, Jun. 4, 2009, Rijswijk, NL, 7 pages.

European Patent Office, Written Opinion, PCT/US2008/009536, Jun. 4, 2009, Munich, DE, 7 pages.

Alpatova, N. M. et al, "Physicochemical Properties and Structure of Complex Compouunds of Aluminium Hydride", Russian Checmial Reviews, 37 (2), 1968, Institute of Electrochemistry, Academy of Scienses of the USSR, Kurnakov Institute of General and Inorganic Chemicstry, Academy of Sciences, Moscow, pp. 99-114.

Bogdanovic & Schwickardi, "Ti-doped Alkali Metal Aluminum Hydrides as Potential Novel Reversible Hydrogen Storage Materials," Journal of Alloys and Compounds, vol. 253-254, 1997, p. 1-9.

Jensen et al, "Advanced Titanium Doping of Sodium Aluminum Hydride: Segue to a Practical Hydrogen Storage Material?" Hydrogen Engery, vol. 24, 1999, p. 461-465.

Zidan et al, "Hydrogen Cycling Behavior of Zirconium and Titanium-Zirconium-Doped Sodium Aluminum Hydride," Journal of Alloys and Compounds, vol. 285, 1999, p. 119-122.

Bogdanovic et al, "Metal-doped Sodium Aluminum Hydrides as Potential New Hydrogen Storage Materials," Journal of Alloys and Compounds, vol. 302, 2000, p. 36-58.

* cited by examiner

*Primary Examiner* — Arun S Phasge
(74) *Attorney, Agent, or Firm* — J. Bennett Mullinax, LLC

(57) ABSTRACT

A process of using an electrochemical cell to generate aluminum hydride ($AlH_3$) is provided. The electrolytic cell uses a polar solvent to solubilize $NaAlH_4$. The resulting electrochemical process results in the formation of $AlH_3$. The $AlH_3$ can be recovered and used as a source of hydrogen for the automotive industry. The resulting spent aluminum can be regenerated into $NaAlH_4$ as part of a closed loop process of $AlH_3$ generation.

8 Claims, 2 Drawing Sheets

ELECTROCHEMICAL PROCESS AND PRODUCTION OF NOVEL COMPLEX HYDRIDES

STATEMENT AS TO RIGHTS TO INVENTIONS MADE UNDER FEDERALLY SPONSORED RESEARCH AND DEVELOPMENT

This invention was made with Government support under Contract No. DE-AC0996-SR18500 awarded by the United States Department of Energy. The Government has certain rights in the invention.

FIELD OF THE INVENTION

This invention is directed towards use of electrochemical cells to generate aluminum hydride ($AlH_3$). The ability to produce the $AlH_3$ in an electrolytic cell allows the possibility of creating a reversible alane product in a cost effective manner which avoids the formation of unused or unwanted byproducts. Other hydrides such as $Mg(AlH_4)_2$ and $Ca(AlH_4)_2$ can be formed by varying the electrodes present within the electrolytic cell. For instance, the same principle can be used to form Borohydride Complexes The invention is further directed to an alane formation using an electrolytic cell which uses polar solvents that dissolve salts and facilitate the conduction of current.

The invention is further directed to an electrolytic process of forming metal hydrides using polar solvents which can be carried out under elevated temperature and/or pressures to facilitate favorable reactions.

BACKGROUND OF THE INVENTION $AlH_3$ has great potential as a source of hydrogen for fuel cells and other technologies. $AlH_3$ is made out of aluminum, which is relatively inexpensive, and has a high weight percent hydrogen when hydrided. Heretofore, the ability to regenerate the aluminum metal back into aluminum hydride has proven to be too expensive for large scale commercial use.

For instance, $AlH_3$ can be formed using very high pressure conditions (105 bars). While such conditions can be achieved in laboratory and small scale demonstration conditions, the high pressures, competing reactions, and overall energy budget have prevented high pressure alane formation from being widely considered for production of alane for a hydrogen storage, fuel cells and other hydrogen energy applications.

Additional conditions for alane formation require plasma conditions or the use of non-economical chemical reactions. Under all these conditions, there are competing reactions that can lead to unstable phases of alane formation and hence generation of an end product that is unsuitable for large scale commercial production of alanes which is needed for fuel cells in the automotive industry.

Accordingly, there remains room for improvement and variation within the art.

SUMMARY OF THE INVENTION

It is one aspect of at least one of the present embodiments to provide for an electrochemical cell using an organic solvent that allows the formation of $AlH_3$ in a cost effective manner.

It is a further aspect of at least one of the present embodiments of the invention to provide for an electrochemical cell in which $NaAlH_4$, in combination with a polar solvent such as tetrahydrofuran (THF) which allows for the direct formation of $AlH_3$.

It is another aspect of at least one of the present embodiments to provide for an electrochemical cell for the production of $AlH_3$ using $NaAlH_4$ dissolved in a polar solvent and using one of at least an elevated pressure or an elevated temperature in order to increase the efficiency of the $AlH_3$ production.

It is a further aspect of at least one of the present embodiments to provide for the production of $AlH_3$ which can be used as a source of hydrogen for use in a vehicle or portable fuel cell devices. The electrochemical process results in producing aluminum hydride at one electrode and NaH at the other electrode. The resulting aluminum hydride may be used as a source of hydrogen for fuel cell applications. The resulting Al metal may then be combined with NaH in a direct hydrogenation reaction, using a titanium catalyst, to yield $NaAlH_4$. The $NaAlH_4$ is subsequently used in an electrochemical cell to produce $AlH_3$. The resulting cyclic production of $AlH_3$ is a closed loop process in which no byproducts are generated.

It is another aspect of at least one embodiment of the present invention to provide for a reversible alane formation in which $AlH_3$ can be used as a source of hydrogen in which the resulting aluminum metal can be hydrogenated in the presence of NaH to provide $NaAlH_4$. Using an electrolytic cell, the $NaAlH_4$ may be used to regenerate the $AlH_3$. The sodium and hydrogen ions produced in the electrochemical cell may be reused in the direct hydrogenation of aluminum metal to regenerate the $NaAlH_4$. $KAlH_4$ dissolved in polar solvent such as THF may also be used as a suitable non-aqueous electrolyte since $KAlH_4$ may be regenerated in a manner similar to $NaAlH_4$ It is yet another aspect of at least one of the present embodiments to provide for a cost effective, reusable process that permits the use of $AlH_3$ as a hydrogen source with the aluminum metal being recharged into a $NaAlH_4$.

These and other features, aspects, and advantages of the present invention will become better understood with reference to the following description and appended claims.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

DESCRIPTION OF THE PREFERRED EMBODIMENT

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

In accordance with the present invention, it has been found that a complex hydride such as $NaAlH_4$ or $KAlH_4$ may be dissolved in the polar solvent THF within an electrolytic cell. The use of an organic solvent avoids reaction of the formed $AlH_3$ in the electrolytic solution which would interfere with the desired reaction. Using a cathode of palladium and an anode of aluminum results in the electrolytic formation of $AlH_3$. While the $AlH_3$ will tend to accumulate on the anode, it has been found that using a small quantity of ether in the THF solvent will dissolve the $AlH_3$ from the anode. Alternatively, it is envisioned that a mechanical scraper, ultrasonic vibration, or similar processes can be used to periodically or continuously remove the deposited $AlH_3$ from the anode.

The electrolytic conditions can be varied to bring about a more efficient production of $AlH_3$. For instance, operating the electrolytic process under high hydrogen pressure will facilitate the reaction speed. Likewise, using the electrolytic process at higher temperatures will also favor a more rapid and efficient reaction rate of $AlH_3$ production. Since the electrolytic conditions are using non-volatile polar solvents, loss of solvents to high temperature is not a limitation.

Example 1

Figure 2:
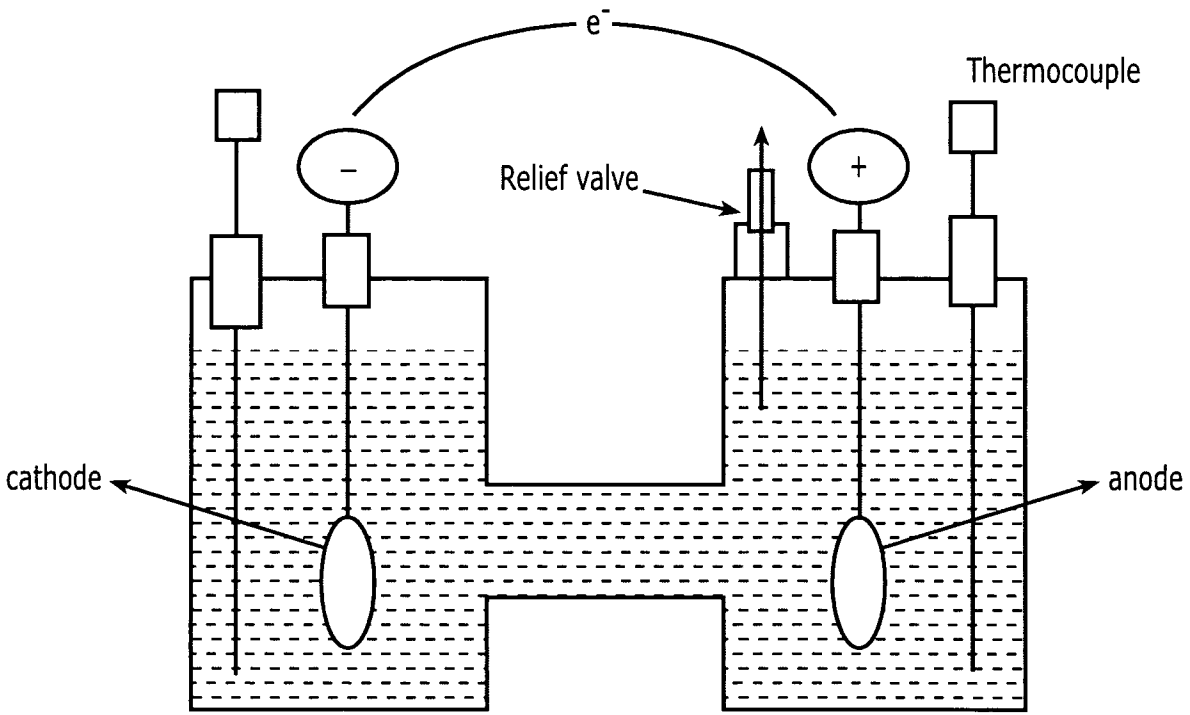
FIG. 2 is a schematic diagram of an electrolytic apparatus which may be used with a non-aqueous electrolyte to form $AlH_3$.

An electrolytic cell, as seen in FIG. 2, was used to produce $AlH_3$ on an aluminum anode and NaH on a palladium hydride cathode and an electrolyte of $NaAlH_4$ dissolved in THF. The reaction occurred at ambient pressure at room temperature using 5 v and 4 ma over a 2 hour period. The formation of $AlH_3$ was detected on the anode. The formation of $AlH_3$ was confirmed using X-ray diffraction.

Example 2

A high pressure electrochemical cell was utilized to generate $AlH_3$. The non-aqueous electrolyte $NaAlH_4$, dissolved in THF, was used in conjunction with a palladium anode and an platinum cathode and an electrolyte of $NaAlH_4$ dissolved in THF. The electrochemical cell was operated under an elevated hydrogen pressure of 500 psi $H_2$ and at a temperature of 60° C. using a voltage of 10 volts over a 2 hour period. The formation of $AlH_3$ was detected on the palladium anode and was subsequently confirmed by X-ray analysis.

As seen in reference to FIG. 1 and Examples 1 and 2, the ability to use an electrochemical cell having dissolved $NaAlH_4$ as an electrolyte and subsequently form $AlH_3$ allows for the desirable production of a reliable source of $AlH_3$ as part of a cyclic process loop. The $AlH_3$ product can be used to generate hydrogen gas for automotive or other commercial purposes. The resulting aluminum metal can be combined with hydrogen in the presence of a titanium catalyst to regenerate $NaAlH_4$ as is known in the art and as set forth and described in the following publications.

B. Bogdanovic and M. Schwickardi. *J. Alloys Comp.* 253-254 (1997);

C. M. Jensen, R. Zidan, N. Mariels, A. Hee and C. Hagen. *Int. J. Hydrogen Energy* 24 (1999), p. 461;

R. A. Zidan, S. Takara, A. G. Hee and C. M. Jensen. *J. Alloys Comp.* 285 (1999), p. 119;

C. M. Jensen, R. A. Zidan, U.S. Pat. No. 6,471,935 (2002); and

B. Bogdanovic, R. A. Brand, A. Marjanovic, M. Schwickardi and J. Tölle. *J. Alloys Comp.* 302 (2000), p. 36, all of which are incorporated herein by reference for all purposes.

Figure 1:
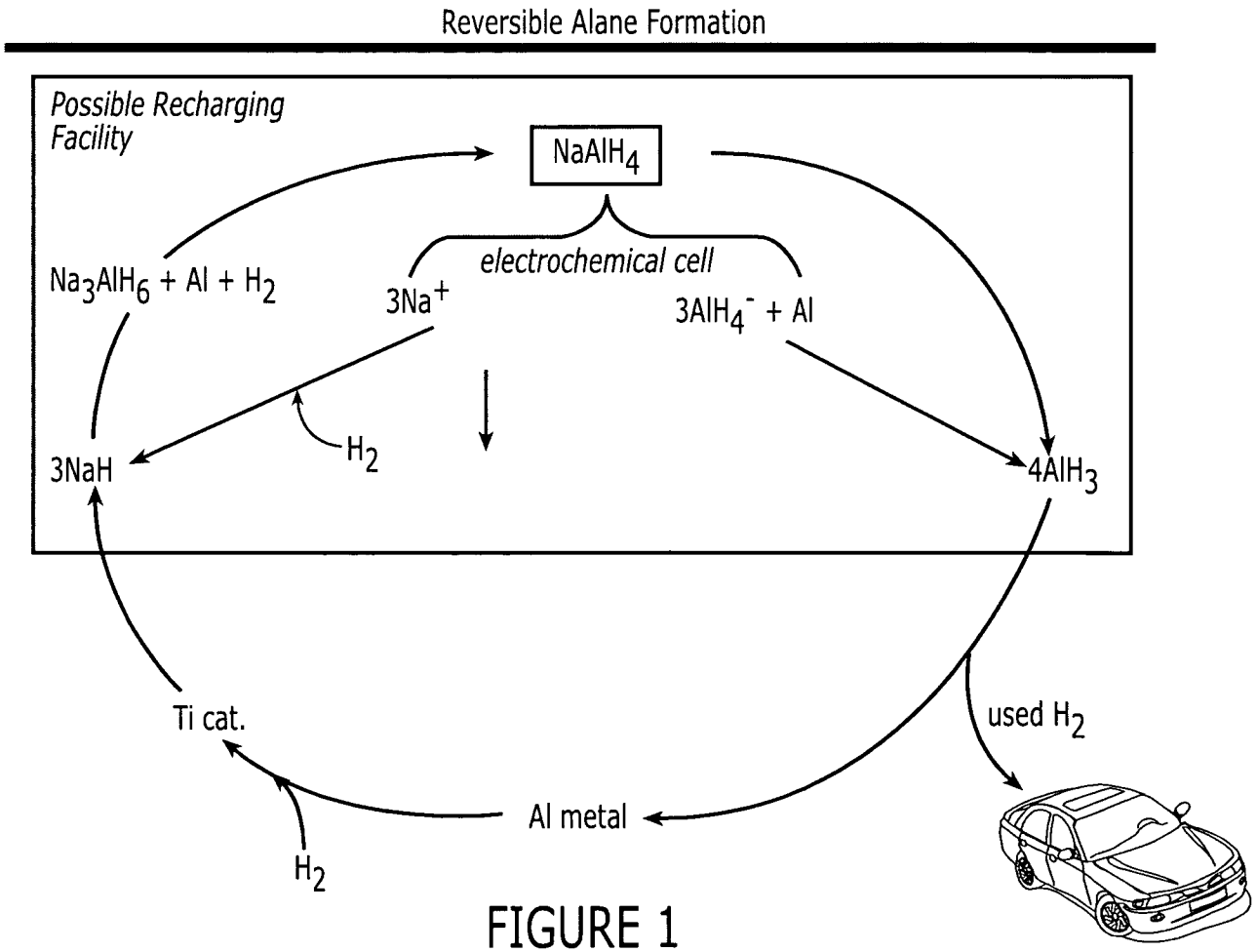
FIG. 1 is a schematic diagram describing the process loop of a reversible alane formation.

As seen in reference to FIG. 1, the entire process loop results in no unused byproducts, but provides for a closed system. The aluminum metal may be again converted into $AlH_3$. Since no byproducts are produced, there is little waste associated with the process.

The ability to generate $AlH_3$ has been demonstrated using a non-aqueous solvent under both ambient conditions and elevated pressure and temperature conditions. While palladium, palladium hydride, platinum and aluminum were used as electrodes in the examples above, it is believed that other material choices for anodes and cathodes may be used.

For instance, suitable electrodes may be provided by palladium, titanium, platinum, zirconium, $LaNi_5$, aluminum, magnesium, calcium, or other hydride forming materials. Hydride forming metals suitable for forming $AlH_3$, borohydrides, and other alanates can be used for the electrolyte.

The induced electric field in the electrochemical cell polarizes the $NaAlH_4$, dissolved in a polar solvent such as THF, into $NA^+$ and $AlH_4^-$ ions. In response to the applied current, the positive sodium ions will migrate to the cathode and the $AlH_4$ negative ions will migrate to the anode. Some non-limiting examples of various anodes and cathodes include the use of an aluminum anode in conjunction with a cathode of Pd. In such a configuration, the Pd can be replaced by Ti, Zr, $LaNi_5$ and other hydride forming materials. Where an aluminum anode is used, Pt can also be used as a cathode where the reaction is $2Na^+ + (Pt+2H)^-(\text{cathode}) \rightarrow 2NaH + Pt$.

$$AlH_4^- + Al^+(\text{anode}) \rightarrow 4AlH_3$$

Yet another combination is the use of Pd as an anode and PdH as a cathode. The respective reactions would include:

$$AlH_4^- + Pd^+(\text{anode}) \rightarrow AlH_3 + PdH.$$

$$Na^+ + PdH^-(\text{cathode}) \rightarrow NaH + Pd$$

From the above non-limiting examples, one of ordinary skill in the art can determine and recognize that enormous variation of materials for anodes and cathodes can be used. In addition, it is believed that without undue experimentation, one having ordinary skill in the art can evaluate various process conditions for the electrolytic cell so as to optimize the production of $AlH_3$ using various combinations of voltage, operating temperature, electrode, and operating pressure. It is also understood that the ability to regenerate aluminum into aluminum hydride holds enormous possibilities as a fuel source of hydrogen for transportation needs. Accordingly, it is recognized that within an overall energy budget, the most desirable operating conditions for generating $AlH_3$ in the electrolytic system described above may be under conditions that may not achieve the highest yield, but does achieve a commercial product in the most cost effective manner.

It is envisioned that the $AlH_3$ can be provided to the automotive industry for use as a hydrogen source at various supply stations and in portable devices in batteries and fuel cells. The spent aluminum metal may be collected and subsequently treated at a commercial facility to regenerate the aluminum metal into an $AlH_3$ using the polar solution electrolyte in an electrochemical cell. Depending upon the processing facility, the electrolytic cell may be operated under high pressure and/or high temperature conditions so as to generate a more favorable reaction rate.

Heretofore, electrolytic processes involving the formation of alanes and other complex hydrides involve the use of salt containing electrolytic solutions, which are detrimental to the desired pathway described herein. In comparison, the present chemical formation process has a very high yield in that there are no competing side reactions that result in undesired end products.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention which is set forth in the following claims. In addition, it should be understood that aspects of the various embodiments may be interchanged, both in whole, or in part. Therefore, the spirit and scope of the appended claims should not be limited to the description of the preferred versions contained therein.

That which is claimed:

1. An electrochemical process of producing $AlH_3$ consisting essentially of:

supplying an anode;

supplying a cathode;

placing said anode and said cathode in an electrolytic solution free of chlorides and comprising THF and $NaAlH_4$ or $KAlH_4$; and, passing a current through the electrochemical cell thereby forming $AlH_3$.

2. The process according to claim 1 wherein said anode is a palladium anode.

3. The process according to claim 1 wherein said cathode is an aluminum cathode.

4. The process according to claim 1 comprising the additional step of removing $AlH_3$ from a surface of said anode.

5. The electrochemical process of producing $AlH_3$ consisting essentially of:

supplying an anode selected from the materials of palladium, platinum, titanium, zirconium, or hydride forming metals;

supplying a cathode selected from the materials of aluminum, magnesium, and calcium;

placing said anode and said cathode in an electrolytic solution free of chlorides containing $NaAlH_4$, said $NaAlH_4$ formed from direct hydrogenation of aluminum, said aluminum being recovered from dehydrided $AlH_3$; and, passing a current through the electrochemical cell thereby forming $AlH_3$.

6. An electrochemical process of producing an alane comprising:

supplying an anode selected from the materials of palladium, platinum, titanium, zirconium, hydride forming metals, and combinations thereof;

supplying a cathode selected from the materials of aluminum, magnesium, calcium, and combinations thereof;

placing said anode and said cathode in an electrolytic solution containing an electrolyte selected from the group consisting essentially of THF. $NaAlH_4$, $KAlH_4$ and combinations thereof; and, passing a current through the electrochemical cell thereby forming a metal hydride.

7. The process according to claim 6 wherein said electrolyte is formed from a dehydrided metal hydride, said metal hydride being formed from the process according to claim 6.

8. An electrochemical process of producing $AlH_3$ comprising:

supplying an anode;

supplying a cathode;

placing said anode and said cathode in an electrolytic solution free of chlorides consisting essentially of THF and $NaAlH_4$ or $KAlH_4$; and, passing a current through the electrochemical cell thereby forming $AlH_3$.

* * * * *